US009932539B2

(12) United States Patent
Chen et al.

(10) Patent No.: US 9,932,539 B2
(45) Date of Patent: Apr. 3, 2018

(54) METHOD FOR EXTRACTING LIPID FROM WET BIOMASS

(71) Applicant: METAL INDUSTRIES RESEARCH & DEVELOPMENT CENTRE, Kaohsiung (TW)

(72) Inventors: Chi-Hui Chen, Kaohsiung (TW); Chun-Hung Hung, Kaohsiung (TW); Tzu-Chen Kuo, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 0 days.

(21) Appl. No.: 15/364,181

(22) Filed: Nov. 29, 2016

(65) Prior Publication Data

US 2018/0066205 A1 Mar. 8, 2018

(30) Foreign Application Priority Data

Sep. 7, 2016 (TW) ..... 105128981 A

(51) Int. Cl.

| | |
|---|---|
| ***C11B 1/00*** | (2006.01) |
| ***C11B 1/10*** | (2006.01) |
| ***C11B 3/00*** | (2006.01) |

(52) U.S. Cl.

CPC ..... *C11B 1/104* (2013.01); *C11B 3/006* (2013.01)

(58) Field of Classification Search

CPC ..... C11B 1/104
USPC ..... 554/21
See application file for complete search history.

(56) References Cited

U.S. PATENT DOCUMENTS 7,329,789 B1 * 2/2008 Schonemann ..... C07C 403/24 210/634

* cited by examiner

*Primary Examiner* — Deborah D Carr
(74) *Attorney, Agent, or Firm* — WPAT, P.C., Intellectual Property Attorneys; Anthony King

(57) ABSTRACT

A method for extracting lipid from wet biomass includes a step in which a wet biomass and a first solvent are mixed to prepare a mixture. The method continues with a step in which said mixture is separated to obtain a solution containing said first solvent and a concentrated biomass. The method continues with a step in which a liquefied gas is added into said concentrated biomass subjected to mechanical dispersion means to obtain lipid.

19 Claims, 1 Drawing Sheet

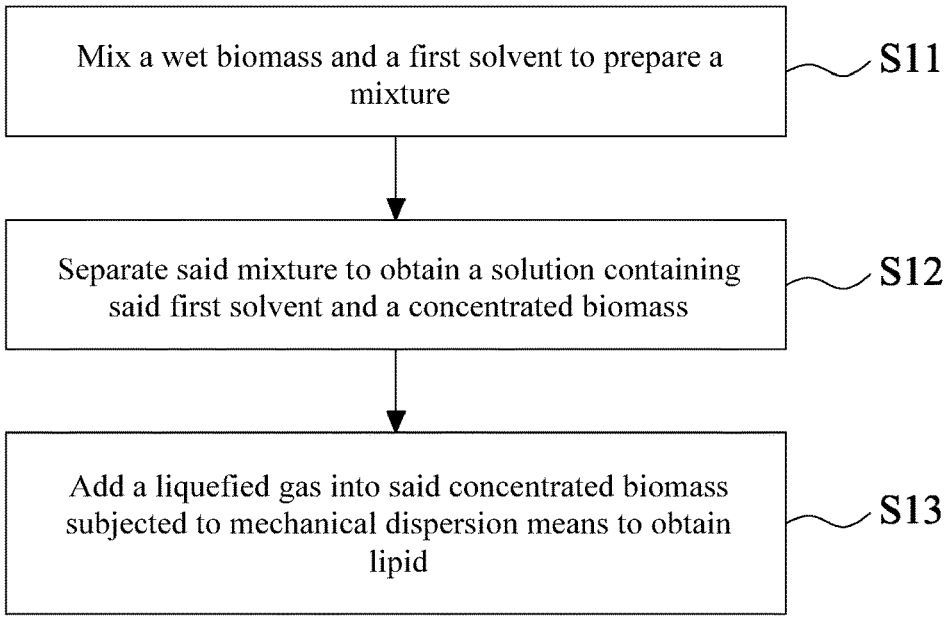
Mix a wet biomass and a first solvent to prepare a mixture
S11
Separate said mixture to obtain a solution containing said first solvent and a concentrated biomass
S12
Add a liquefied gas into said concentrated biomass subjected to mechanical dispersion means to obtain lipid
S13

METHOD FOR EXTRACTING LIPID FROM WET BIOMASS

FIELD

The disclosure relates to a method for extracting lipid, more particular to a method for extracting lipid from wet biomass.

BACKGROUND

Because of rapid growth and a capability of producing lipid, biomass, such as algae, currently becomes a popular source of biomass energy and nutritive health-care ingredient. Said biomass generally grows in an aqueous environment and therefore, contains extremely high water content when being harvested.

To prevent water from hindering lipid extraction of biomass, a known extraction method has proposed performing dewatering treatment, such as high-temperature drying or low-temperature drying treatment, on wet biomass. However, high-temperature drying treatment would cause a loss or a qualitative change of a thermally unstable substance in said biomass, and freeze drying treatment has extremely high energy consumption and a long treatment time, which, therefore, are unfavorable to commercial operation.

SUMMARY OF THE INVENTION

In accordance with one aspect of the present disclosure, a method for extracting lipid from wet biomass includes a step in which a wet biomass and a first solvent are mixed to prepare a mixture. The method continues with a step in which said mixture is separated to obtain a solution containing said first solvent and a concentrated biomass. The method continues with a step in which a liquefied gas is added into said concentrated biomass subjected to mechanical dispersion means to obtain lipid.

In accordance with another aspect of the present disclosure, a method for extracting lipid from wet biomass includes a step in which a wet cell-disrupted biomass and a first solvent are mixed to prepare a mixture. The method continues with a step in which said mixture is separated to obtain a solution containing said first solvent and a concentrated biomass. The method continues with a step in which a liquefied gas is added into said concentrated biomass subjected to mechanical dispersion means to obtain lipid.

The method of the present disclosure can be used to directly extract lipid from wet biomass, where said wet biomass does not need to undergo dewatering treatment such as high-temperature drying or freeze drying, and therefore, is extremely suitable for commercial operation. Furthermore, the method of the present disclosure can be carried out in a room-temperature environment. Therefore, energy consumption can be reduced and an extracted ingredient can be prevented from being lost or qualitatively changed because of a high temperature.

BRIEF DESCRIPTION OF THE DRAWINGS

Aspects of the present disclosure are understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 1 shows a flow diagram of a method for extracting lipid from wet biomass according to the present disclosure.

DETAILED DESCRIPTION OF THE INVENTION

It is to be understood that the following disclosure provides many different embodiments or examples, for implementing different features of various embodiments. Specific examples of components and arrangements are described below to simplify the present disclosure. The present disclosure may, however, be embodied in many different forms and should not be construed as being limited to the embodiments set forth herein; rather, these embodiments are provided so that this description will be thorough and complete, and will fully convey the present disclosure to those of ordinary skill in the art. It will be apparent, however, that one or more embodiments may be practiced without these specific details.

In addition, the present disclosure may repeat reference numerals and/or letters in the various examples. This repetition is for the purpose of simplicity and clarity and does not in itself dictate a relationship between the various embodiments and/or configurations discussed.

It will be understood that singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

FIG. 1 shows a flow diagram of a method for extracting lipid from wet biomass according to the present disclosure. Referring to step S11 of FIG. 1, a wet biomass and a first solvent are mixed to prepare a mixture. In this step, said wet biomass can be algae, fungi, animal slurry, or plant slurry, and preferably, the moisture of said wet biomass is 30 to 99.5 wt % inclusive. In some embodiments, said wet biomass can be a wet cell-disrupted biomass.

Said foregoing algae include, but are not limited to one of the following: green algae (chlorophytes), diatom (bacillariophytes), blue-green algae (cyanophytes), golden-brown algae (chrysophytes), freshwater algae, saltwater algae, *Spirulina, Haematococcus, Chlorella, Nannochloropsis, Nannochloris, Tetraselmis, Chrysophyta, Cryptomonadales, Scenedesmus, Dunaliella, Botryococcus braunii, Stichococcus, Neochloris oleoabundans, Aurantiochytrium, Thraustochytrium, Schizochytrium, Crypthecodinium cohnii, Ulkenia* or a mixture thereof.

Said foregoing fungi include, but are not limited to one of the following: yeast, *Escherichia coli,* and *Lactobacillus.*

An ingredient of said foregoing animal slurry includes one of the following: fish, shrimp, shell fish, fowl, pigs, cattle, sheep, and chickens. In addition, the slurry ingredient includes skin, meat, bones, or shells of the foregoing animals, or a mixture thereof.

An ingredient of said foregoing plant slurry includes one of the following: fruits, fruit pulp, peel, fruit seeds, seed coats, roots, stems, or leaves of plants, or a mixture thereof.

In this embodiment, to obtain a preferable lipid extraction rate, said wet biomass needs to undergo disruptive treatment to form a wet cell-disrupted biomass, where said disruptive treatment can include one or more of the following treatment means: bead-beating, high-pressure homogenization, high-speed homogenization, ultrasonic treatment, microwave treatment, ultrahigh-pressure treatment, steam explosion, microfluidizer treatment, freeze drying treatment, fast decompression treatment, osmotic shock treatment, thermal treatment, supercritical carbon dioxide treatment, enzyme treatment, detergent treatment, chelating agent treatment, acid treatment, alkali treatment, antibiotic treatment, solvent treatment, phage treatment, and autolysis treatment. In addition, a mixing volume ratio of said wet biomass to said first solvent should be controlled between 1:0.25 and 1:3 inclusive, and the temperature of mixing the two should be controlled between 4 and 50° C. inclusive.

Furthermore, to further improve the lipid extraction rate, said first solvent should be selected from a water-soluble solvent such as methanol, ethanol, isopropanol, propylene glycol, acetone, or a mixture thereof.

Referring to step S12, said mixture is separated to obtain a solution containing said first solvent and a concentrated biomass. In this step, a method for separating the mixture can be gravitational settling, centrifugation, filtration, depressurization, or vaporization. In addition, the moisture of said concentrated biomass should be 15 to 95% of the moisture of said wet biomass, so as to prevent excess water from hindering lipid extraction of said concentrated biomass.

Referring to step S13, a liquefied gas is added into said concentrated biomass subjected to mechanical dispersion means to obtain lipid. In this step, said mechanical dispersion means includes using an agitator, a thin-film extractor, or a static mixer. An apparatus of the foregoing thin-film extractor can be described by using the TW patent No. I457436 as an example, where a rotor is disposed inside the thin-film extractor, and said rotor is provided with several radius rods and serves as a mechanical tool forming said thin film. Said mechanical dispersion means of this embodiment is using an agitator, where said agitator includes a rotation shaft, said rotation shaft is provided with more than one blade (not shown in the drawings), and a rotational speed of said rotation shaft of said agitator should be controlled between 30 and 1000 rpm inclusive, so as to achieve an even dispersion and extraction effect.

In this embodiment, to obtain a preferable lipid extraction rate, a working pressure of said liquefied gas should be controlled between 5 and 100 bar inclusive, and a working temperature thereof should be controlled between 15 to 80° C. inclusive, so as to prevent a high temperature from destroying ingredients of said concentrated biomass.

In addition, to further improve the lipid extraction rate, said liquefied gas is propane, butane, iso-butane, fluorcycloalkane, HFCs refrigerant, HFOs refrigerant, or a mixture thereof. Said HFCs refrigerant comprises 1,1,1,2-tetrafluoroethane. Said HFOs refrigerant comprises 2,3,3,3-tetrafluoropropene.

In order to extract said lipid having a carbon number more than 20, in this step, a second solvent can be added, the polarity of said second solvent should be greater than the polarity of said liquefied gas, and a volume ratio of said second solvent to said liquefied gas should be controlled between 1:10 and 1:100 inclusive. In this embodiment, said second solvent can be ethanol, isopropanol, ethyl acetate, acetone, or a mixture thereof.

When the lipid extraction is completed, a depressurization step can be performed to vaporize and separate said liquefied gas, so as to further recycle it.

The method of the present disclosure can be used to directly extract lipid from wet biomass, where said wet biomass does not need to undergo dewatering treatment such as high-temperature drying and freeze drying, and therefore, is extremely suitable for commercial operation. Furthermore, the method of the present disclosure can be carried out in a low-temperature environment. Therefore, energy consumption can be reduced and the extracted ingredient can be prevented from being lost or qualitatively changed because of high temperature.

The present disclosure is illustrated in detail with the following embodiments, but it does not mean that the present disclosure is only limited to the content disclosed by these embodiments.

Embodiment 1

Mix a wet cell-disrupted microalgae (the moisture is about 82%) and ethanol, and getting the mixture having a volume ratio of 1:1 stand for 16 hours at a temperature of 26° C. to prepare an algae-ethanol mixture.

Centrifugally separate said algae-ethanol mixture to obtain a green ethanol solution and an algal slurry (the moisture is about 62%).

Use liquefied propane to extract said algal slurry by means of an agitator for two hours under the pressure of 30 bar at the temperature of 50° C., where a lipid extraction rate is about 75%.

Embodiment 2

Mix a wet cell-disrupted yeast (the moisture is about 82%) and methanol, and mixing said wet cell-disrupted yeast and said methanol at a volume ratio of 1:2 with stirring for 30 minutes at a temperature of 28° C. to prepare a yeast-methanol mixture.

Centrifugally separate said yeast-methanol mixture to obtain an orange methanol solution and a yeast slurry (the moisture is about 51%).

Use liquefied propane to extract said yeast slurry by means of an agitator for two hours under the pressure of 30 bar at the temperature of 50° C., where a lipid extraction rate is about 96%.

Embodiment 3

Mix a wet yeast (the moisture is about 62%) and methanol, and mixing said yeast and said methanol at a volume ratio of 1:2 with stifling for 30 minutes at a temperature of 29° C. to prepare a yeast-methanol mixture.

Centrifugally separate said yeast-methanol mixture to obtain an orange methanol solution and a yeast slurry (the moisture is about 51%).

Use liquefied propane to extract said yeast slurry by means of an agitator for two hours under the pressure of 30 bar at the temperature of 50° C., where a lipid extraction rate is about 82%.

Moreover, the scope of the present application is not intended to be limited to the particular embodiments of the process, machine, manufacture, and composition of matter, means, methods and steps described in the specification. As those skilled in the art will readily appreciate form the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure.

Accordingly, the appended claims are intended to include within their scope such processes, machines, manufacture, and compositions of matter, means, methods or steps. In addition, each claim constitutes a separate embodiment, and the combination of various claims and embodiments are within the scope of the invention.

What is claimed is:

1. A method for extracting lipid from wet biomass, comprising:

(a) mixing a wet biomass and a first solvent to prepare a mixture;

(b) separating said mixture to obtain a solution containing said first solvent and a concentrated biomass; and (c) adding a liquefied gas into said concentrated biomass subjected to mechanical dispersion means to obtain lipid.

2. The method of claim 1, wherein said wet biomass of the step (a) is algae, fungi, animal slurry, or plant slurry.

3. The method of claim 1, wherein the moisture of said wet biomass of the step (a) is 30 to 99.5 wt % inclusive.

4. The method of claim 1, wherein said first solvent is methanol, ethanol, isopropanol, propylene glycol, acetone, or a mixture thereof.

5. The method of claim 1, wherein a mixing volume ratio of said wet biomass to said first solvent is between 1:0.25 and 1:3 inclusive.

6. The method of claim 1, wherein the moisture of said concentrated biomass of the step (b) is 15 to 95% of the moisture of said wet biomass of the step (a).

7. The method of claim 1, wherein said liquefied gas of the step (c) is propane, butane, iso-butane, fluorcycloalkane, HFCs refrigerant, HFOs refrigerant, or a mixture thereof.

8. The method of claim 7, wherein said HFCs refrigerant comprises 1,1,1,2-tetrafluoroethane.

9. The method of claim 7, wherein said HFOs refrigerant comprises 2,3,3,3-tetrafluoropropene.

10. The method of claim 1, wherein said mechanical dispersion means of the step (c) comprises using an agitator, a thin-film extractor, or a static mixer.

11. The method of claim 1, wherein the working pressure of said liquefied gas is between 5 and 100 bar inclusive, and the working temperature thereof is between 15 to 80° C. inclusive.

12. The method of claim 1, wherein the step (c) further comprises adding a second solvent to extract lipid having a carbon number more than 20, wherein the polarity of said second solvent is greater than the polarity of said liquefied gas, and said second solvent is ethanol, isopropanol, ethyl acetate, acetone, or a mixture thereof.

13. The method of claim 12, wherein the volume ratio of said second solvent to said liquefied gas is between 1:10 and 1:100 inclusive.

14. A method for extracting lipid from wet biomass, comprising:

(a) mixing a wet cell-disrupted biomass and a first solvent to prepare a mixture;

(b) separating said mixture to obtain a solution containing said first solvent and a concentrated biomass; and (c) adding a liquefied gas into said concentrated biomass subjected to mechanical dispersion means to obtain lipid.

15. The method of claim 14, wherein said first solvent is methanol, ethanol, isopropanol, propylene glycol, acetone, or a mixture thereof.

16. The method of claim 14, wherein said liquefied gas is propane, butane, iso-butane, fluorcycloalkane, HFCs refrigerant, HFOs refrigerant, or a mixture thereof.

17. The method of claim 16, wherein said HFCs refrigerant comprises 1,1,1,2-tetrafluoroethane.

18. The method of claim 16, wherein said HFOs refrigerant comprises 2,3,3,3-tetrafluoropropene.

19. The method of claim 14, wherein said mechanical dispersion means of the step (c) comprises using an agitator, a thin-film extractor, or a static mixer.

* * * * *